US008413860B2

(12) United States Patent
Mojtabavi

(10) Patent No.: US 8,413,860 B2
(45) Date of Patent: Apr. 9, 2013

(54) PULLOVER GARMENT HANGER ASSEMBLY

(76) Inventor: Mehdi Mojtabavi, Portland, OR (US)

( * ) Notice: Subject to any disclaimer, the term of this patent is extended or adjusted under 35 U.S.C. 154(b) by 0 days.

(21) Appl. No.: 13/130,757

(22) PCT Filed: Nov. 23, 2009

(86) PCT No.: PCT/US2009/065543
§ 371 (c)(1),
(2), (4) Date: May 24, 2011

(87) PCT Pub. No.: WO2010/060044
PCT Pub. Date: May 27, 2010

(65) Prior Publication Data

US 2011/0226820 A1 Sep. 22, 2011

Related U.S. Application Data

(60) Provisional application No. 61/200,133, filed on Nov. 24, 2008.

(51) Int. Cl.
*A41D 27/22* (2006.01)

(52) U.S. Cl.
USPC ..... 223/94; 223/85; 223/92

(58) Field of Classification Search ..... 223/85, 223/89, 90, 94, 98
See application file for complete search history.

(56) References Cited

U.S. PATENT DOCUMENTS

| | | | | |
|---|---|---|---|---|
| 2,586,913 | A * | 2/1952 | Burns | 223/94 |
| 2,774,526 | A * | 12/1956 | Reuer | 223/89 |
| 2,949,649 | A | 6/1960 | Zeuthen | |
| 5,046,649 | A | 9/1991 | Hazenveld | |
| 5,069,373 | A * | 12/1991 | Kolton et al. | 223/85 |
| 5,236,109 | A * | 8/1993 | Zuckerman | 223/96 |
| 5,590,823 | A * | 1/1997 | Lunde | 223/94 |
| 6,540,121 | B1 * | 4/2003 | Harvey | 223/85 |

FOREIGN PATENT DOCUMENTS

| | | |
|---|---|---|
| GB | 673207 | 6/1952 |
| GB | 876575 | 9/1961 |

* cited by examiner

*Primary Examiner* — Nathan Durham
(74) *Attorney, Agent, or Firm* — Stoel Rives LLP

(57) ABSTRACT

A hanger assembly allows a user to hang a pullover garment from its top and remove the pullover garment quickly and easily without damaging it. The hanger assembly includes a rigid handle to which is joined an elongated flexible holder. The rigid handle has a hook portion and a holder carrier portion including first and second opposed coupling members. The flexible holder is operationally coupled for slidable engagement with the first and second coupling members to allow the flexible holder to transition between a lengthwise compressed state and a partly relaxed state to hang the garment and between the partly relaxed state and a break free state to remove the garment without stretching its neck opening.

16 Claims, 11 Drawing Sheets

PULLOVER GARMENT HANGER ASSEMBLY

RELATED APPLICATION

This application claims benefit under 35 U.S.C. §119(e) of U.S. Provisional Patent Application No. 61/200,133, filed Nov. 24, 2008.

TECHNICAL FIELD

The present disclosure relates to an upper body garment hanging apparatus, and more particularly to a hanger assembly for hanging a pullover garment from its top.

BACKGROUND INFORMATION

Pullover garments such as T-shirts, sweaters, sweatshirts, polo shirts, rugby shirts, henley shirts, and sleeveless shirts (e.g., tank tops) are well-known. For example, T-shirts—which are relatively comfortable, simple, light, and affordable—are very popular, especially among young people.

One way to keep pullover garments in shape without substantial wrinkling when they are not worn is to store them on hangers. However, currently available hangers are not generally well-designed for pullover garments. The specific shape and rigid structure of known hangers often leave users frustrated when they want to hang pullover garments from the top. For example, to avoid substantial stretching of, and consequent damage to, the neck opening, a user will often insert a hanger through the bottom opening of the pullover garment and maneuver the hanger into position, which routine is time and energy consuming. Moreover, the user risks damaging the pullover garment when the hanger is inserted through the bottom opening. When the user wishes to remove the pullover garment from the hanger, the user must either remove the hanger through the neck opening and risk substantial stretching thereof or maneuver the hanger out the bottom opening.

SUMMARY OF THE DISCLOSURE

Preferred embodiments of a hanger assembly allow a user to hang and remove a pullover garment quickly and easily without damaging it. According to one embodiment, the hanger assembly for hanging a pullover garment from its top includes a rigid handle to which is joined an elongated flexible holder.

The rigid handle has a holder carrier portion and an hook portion. The holder carrier portion includes first and second support arms having distal ends at which are formed respective first and second opposed coupling members. The hook portion is positioned medially between the first and second coupling members.

The elongated flexible holder, when joined with the rigid handle to form the hanger assembly, is operationally coupled for slidable engagement with the first and second coupling members. The flexible holder has holder ends and a lengthwise profile, a cross-sectional profile, and a length. The lengthwise profile is configured to define a bow shape in a rest state. The cross-sectional profile is configured to achieve, in response to a holder compressive applied force, bending of the flexible holder in a lengthwise compressed state and thereby bring closer together the holder ends to enable insertion of the holder ends through the neck opening to the interior of the pullover garment, and, in response to a garment removal applied force, buckle-free bending of the flexible holder in a lengthwise break-free state and thereby bringing closer together the holder ends to enable removal of the holder ends through the neck opening from the interior of the pullover garment. The length of the flexible holder is selected to achieve, in response to removal of the holder compressive applied force and a consequent relaxation of the flexible holder from the compressed state to a partly relaxed state, a spreading apart of the holder ends to allow the flexible holder to span beyond each of the first and second coupling members a distance that enables the pullover garment to hang on the flexible holder, with the flexible holder following the shoulder line profile of the pullover garment.

Additional aspects and advantages will be apparent from the following detailed description of preferred embodiments, which proceeds with reference to the accompanying drawings.

DETAILED DESCRIPTION OF PREFERRED EMBODIMENTS

With reference to the above-listed drawings, this section describes particular embodiments and their detailed construction and operation. The embodiments described herein are set forth by way of illustration only and not limitation. Skilled persons will recognize in light of the teachings herein that there is a range of equivalents to the example embodiments described herein. Most notably, other embodiments are possible, variations can be made to the embodiments described herein, and there may be equivalents to the components, parts, or steps that make up the described embodiments.

For the sake of clarity and conciseness, certain aspects of components or steps of certain embodiments are presented without undue detail that would be apparent to skilled persons in light of the teachings herein or would obfuscate an understanding of more pertinent aspects of the embodiments.

Figure 1:
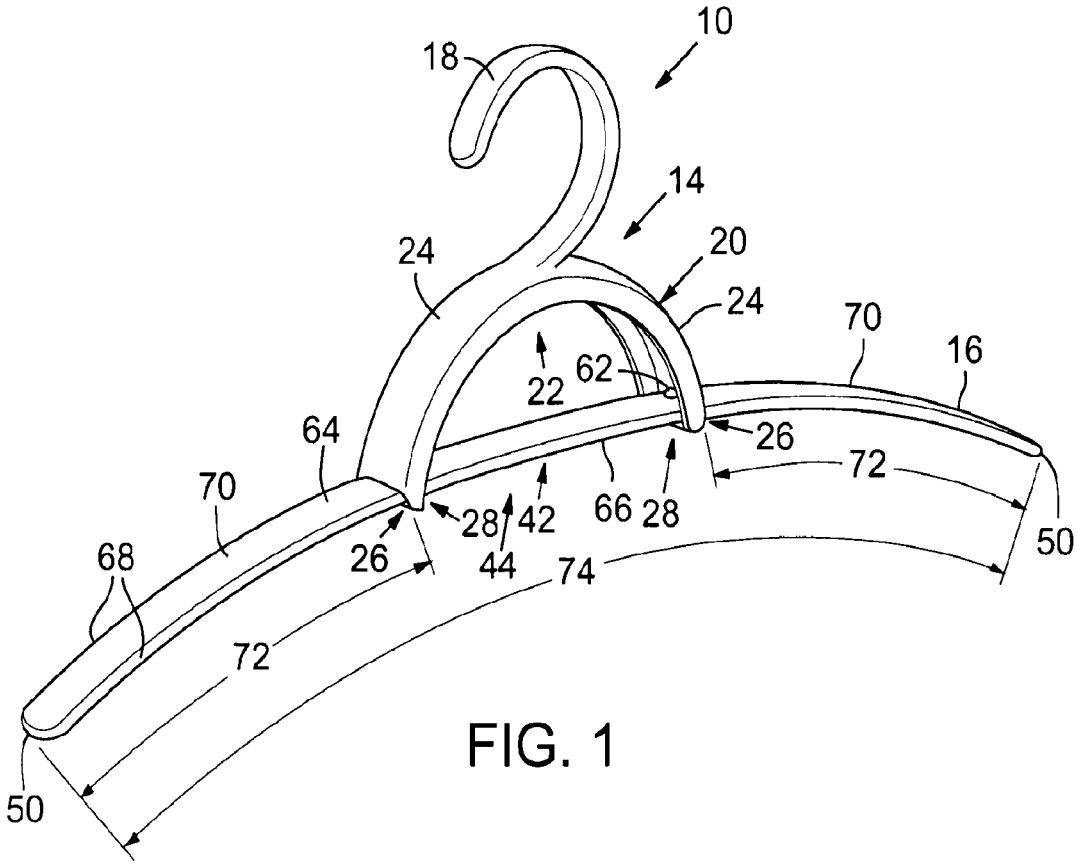
FIG. 1 is a perspective view of a hanger assembly composed of a rigid handle and flexible holder according to one embodiment.

FIG. 1 is a perspective view of a hanger assembly 10, according to one embodiment, for hanging a pullover garment (such as a T-shirt 12 shown in FIGS. 11B, 11C, and 11D) from its top. Although the following disclosure refers to T-shirt 12, hanger assembly 10 may be used with other types of pullover garments such as sweaters, sweatshirts, polo shirts, rugby shirts, henley shirts, and sleeveless shirts (e.g., tank tops). Hanger assembly 10 includes a rigid handle 14 and an elongated flexible holder 16 that are designed to allow a user to hang and remove T-shirt 12 quickly and easily without damaging it.

Rigid handle 14 includes a hook portion 18 and a holder carrier portion 20. Hook portion 18 may be an integral part of holder carrier portion 20 to establish a unitary structure for rigid handle 14. Rigid handle 14 may be made of any suitable material such as, but not limited to, plastic, wood, or metal. Hook portion 18 is positioned at and extends generally in an upward direction from a center region 22 of holder carrier portion 20 to allow hanger assembly 10 to suspend from a support member (not shown) such as a closet rod. Hook portion 18 and holder carrier portion 20 are preferably shaped to provide an aesthetically pleasing design for rigid handle 14. In one example, as shown in FIG. 1, holder carrier portion 20 resembles an arch having an apex from which curved hook portion 18 outwardly grows to form a tendril-like junction between hook portion 18 and holder carrier portion 20.

Figure 2A:
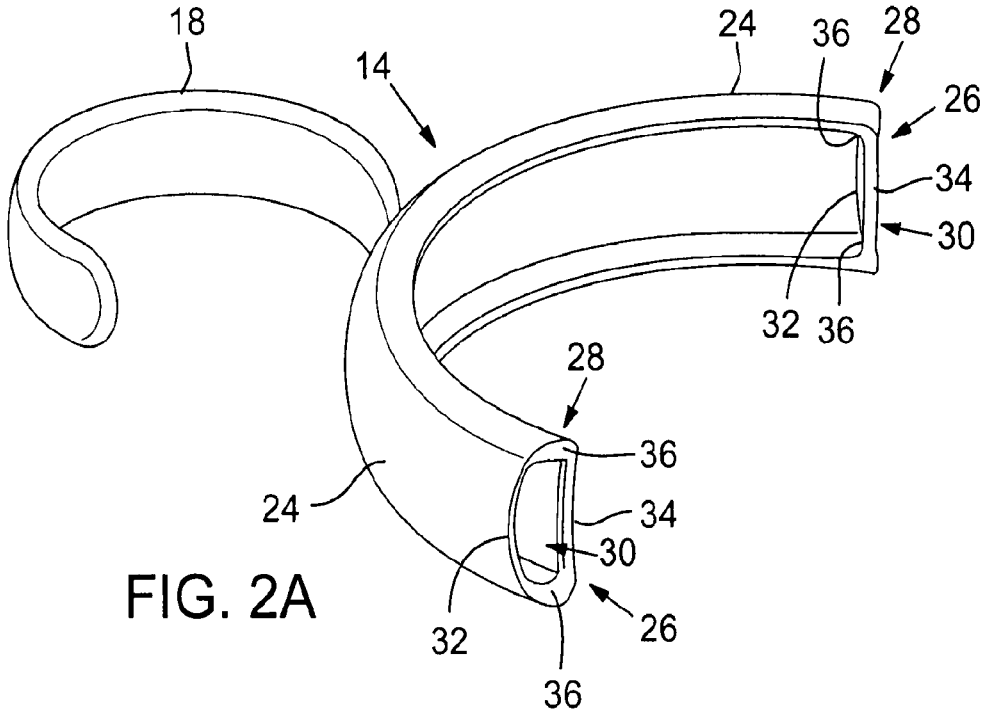
FIG. 2A is a perspective view of the rigid handle of the hanger assembly of FIG. 1.

Holder carrier portion 20 includes support arms 24 in the form of arc sections that extend in opposite directions from center region 22 and establish a curved shape for holder carrier portion 20. Support arms 24 include at their respective distal ends 26 opposed coupling members 28 that allow flexible holder 16 to be joined with and slide relative to rigid handle 14. As shown in FIG. 2A, coupling members 28 include apertures 30 that are configured to receive and allow movement of flexible holder 16 relative to support arms 24 to achieve operational coupling for slidable engagement with coupling member 28. Apertures 30 are defined by a convex segment 32 and a concave segment 34 that are opposed to each other and interconnected by opposed convex lateral segments 36. Alternatively, segments 32, 34, and 36 may have other shapes including a substantially flat profile. In one example, segments 32, 34, and 36 define a closed perimeter (e.g., a contiguous ring) for apertures 30. However, segments 32, 34, and 36 need not form a closed perimeter for apertures 30. For example, one or more of segments 32, 34, and 36 may include a gap (not shown) so that segments 32, 34, and 36 do not completely surround cross-sectional profile 38 of flexible holder 16 when it is joined to rigid handle 14.

Figure 2B:
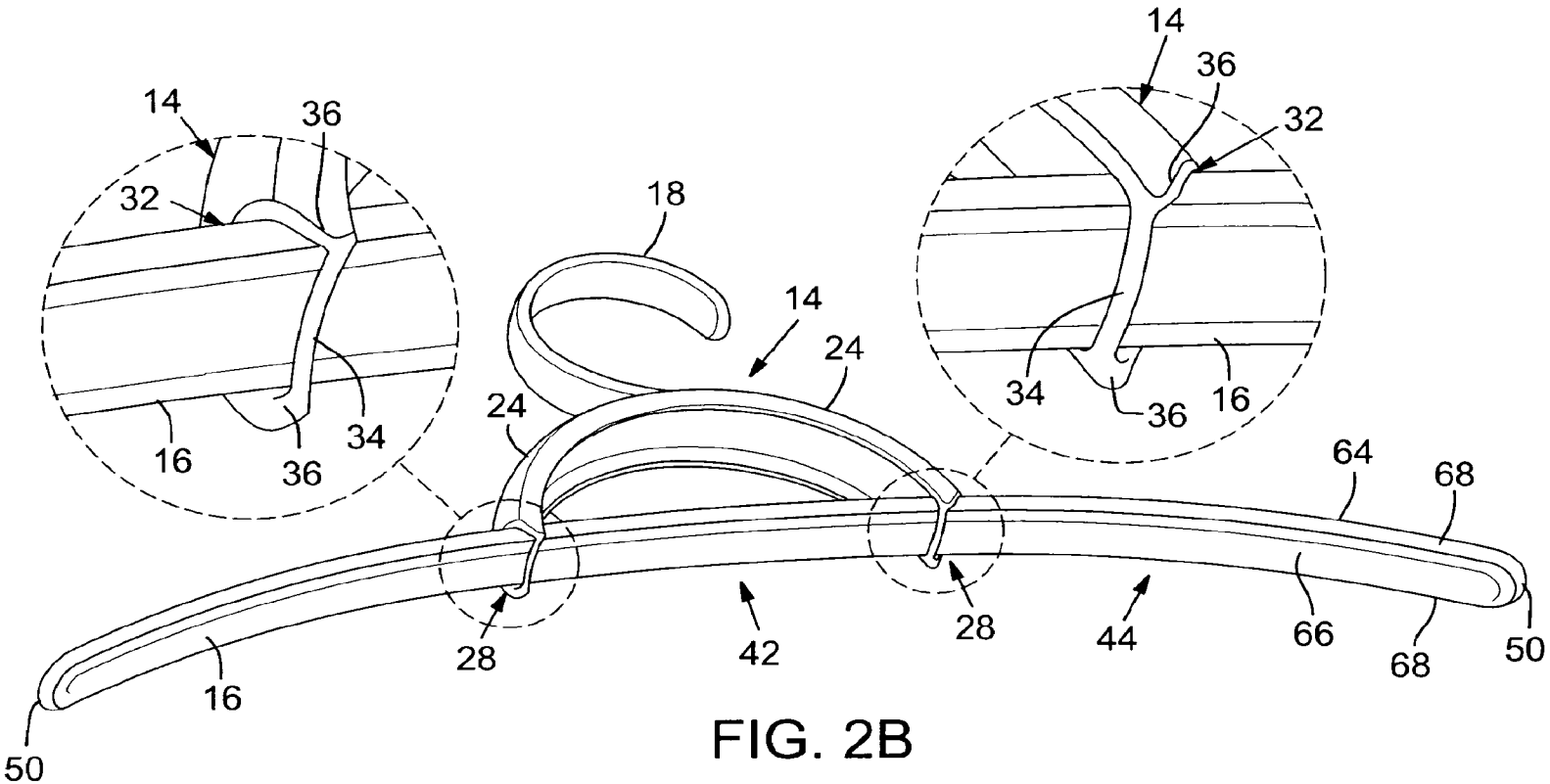
FIG. 2B is a perspective view of the hanger assembly of FIG. 1 shown in a rotated orientation with magnified views of two opposed coupling members at the distal ends of the rigid handle to illustrate the complementary shapes of the coupling member apertures and the flexible holder received by them.
Figure 4:
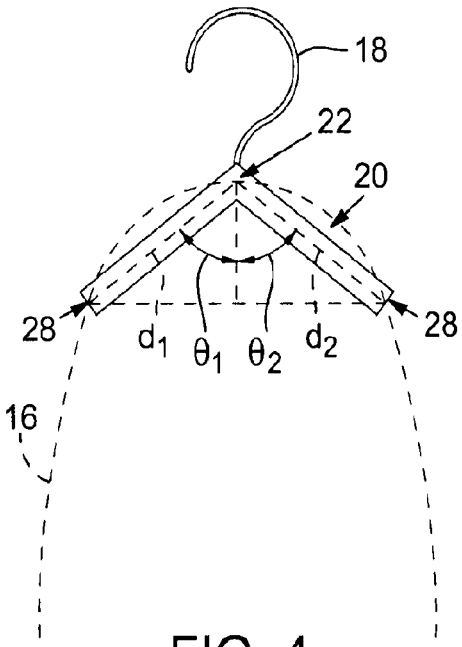
FIGS. 4, 5, 6, and 7 are frontal views of various alternative embodiments of the rigid handle of the hanger assembly of FIG. 1.
Figure 5:
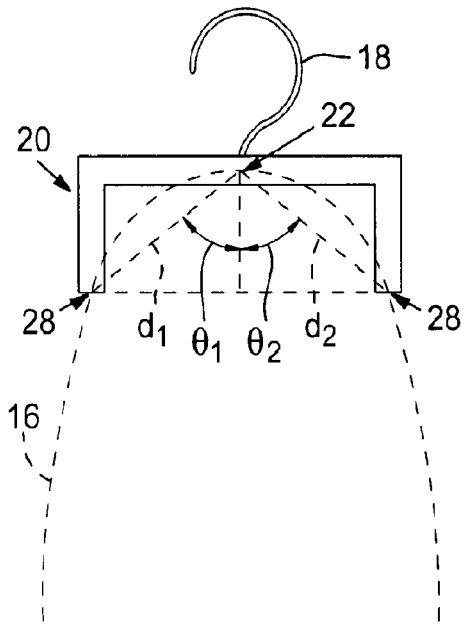
Figure 6:
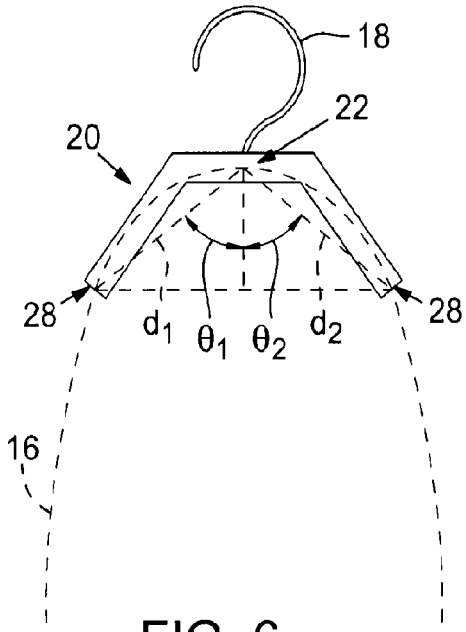
Figure 7:
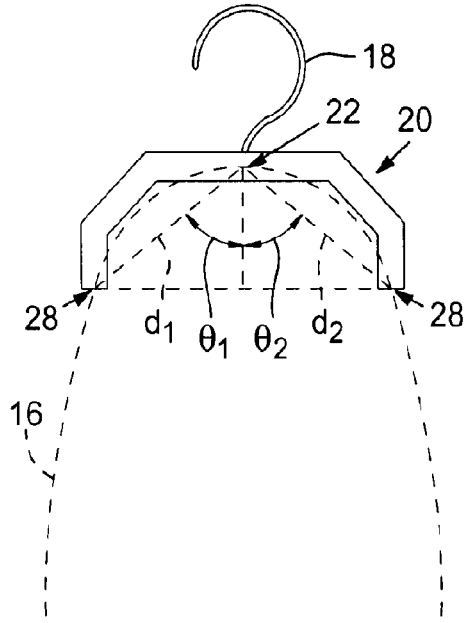
Figure 9A:
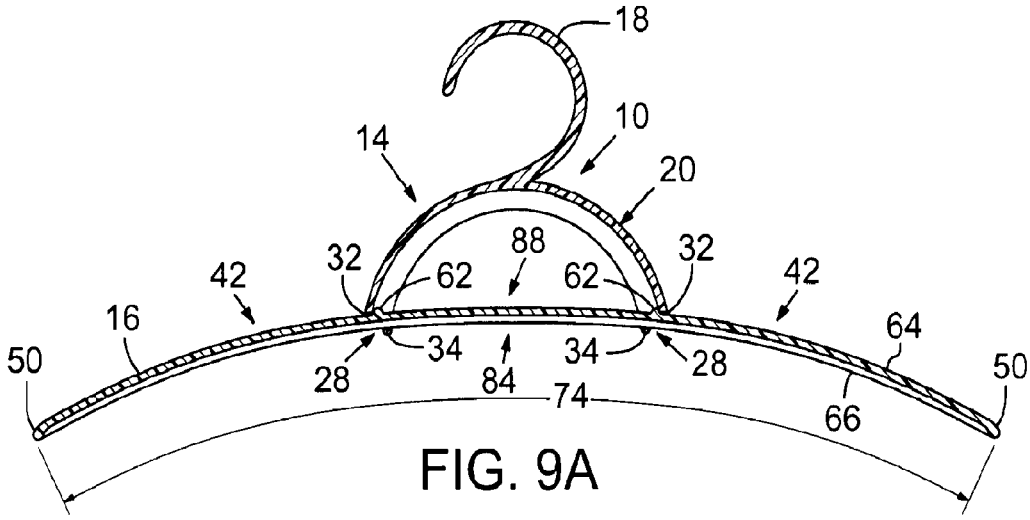
FIGS. 9A, 9B, and 9C show, for the hanger assembly of FIG. 1, the flexible holder embodied in, respectively, uniform, nonuniform inwardly tapered, and nonuniform outwardly tapered longitudinal cross-sectional profiles.
Figure 10:
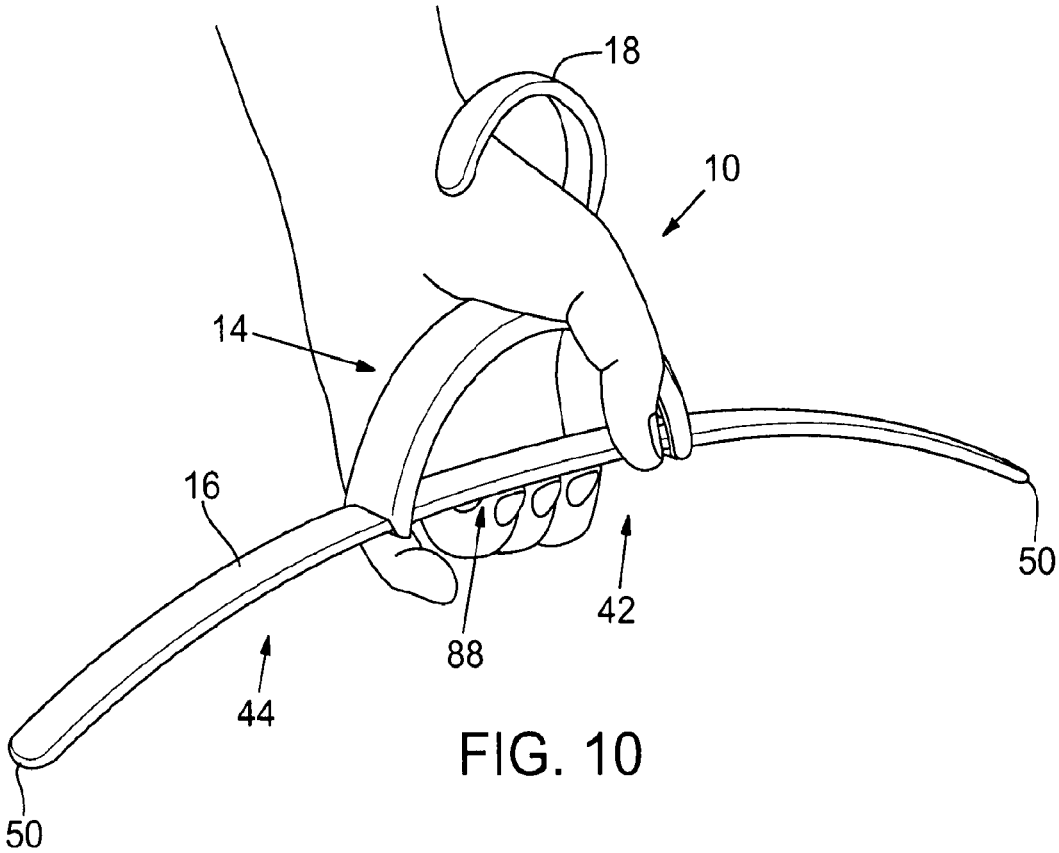
FIG. 10 is a perspective view of the hanger assembly of FIG. 1 held in a user's hand and preparatory to the user applying an upwardly directed compressive force to the flexible holder.
Figures 11A, 11B, 11C, 11D, 11E:
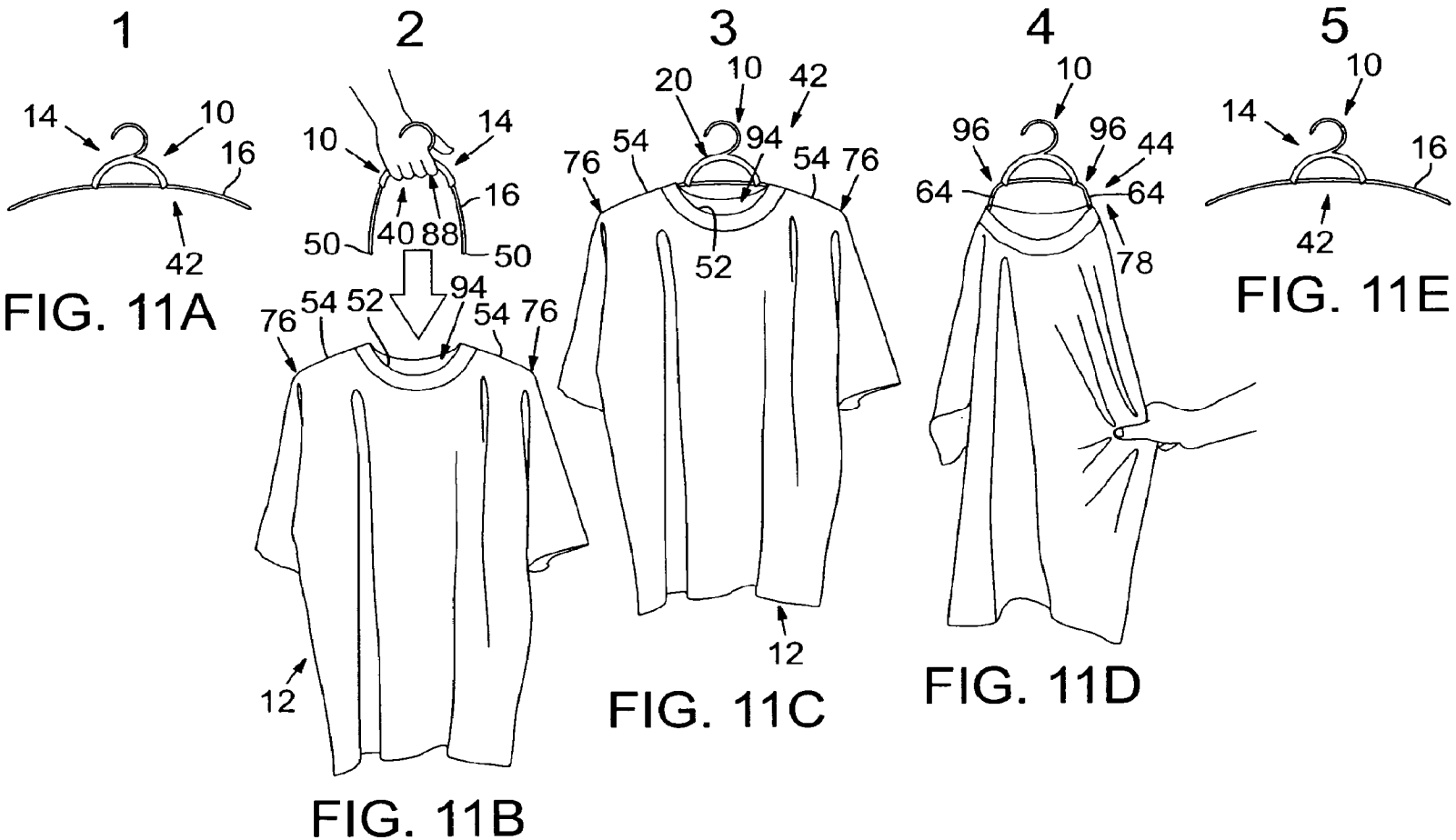
FIG. 11A is a frontal view of the hanger assembly of FIG. 1 before a T-shirt has been placed on the hanger assembly.
FIG. 11B is a frontal view of the hanger assembly of FIG. 1 with the flexible holder urged to a lengthwise compressed state for insertion into the interior of a pullover garment when the user squeezes his hand around the rigid handle and the flexible holder to apply a compressive force to the flexible holder to bend it.
FIG. 11C is a frontal view of the hanger assembly of FIG. 1 inserted in the interior of a T-shirt, with the T-shirt resting on the flexible holder in a partly relaxed state.
FIG. 11D is a frontal view of the hanger assembly and T-shirt of FIG. 11C showing a user applying to the T-shirt a downwardly directed force to pull the garment off the flexible holder and thereby remove the T-shirt from the hanger assembly.
FIG. 11E is a frontal view of the hanger assembly of FIG. 1 after the T-shirt of FIG. 11D has been removed from the hanger assembly.

As shown in FIG. 2B, segments 32, 34, and 36 are compatibly shaped with a cross-sectional profile 38 (FIG. 8A) of flexible holder 16 to accommodate transitional bending of flexible holder 16 between a lengthwise compressed state 40 (shown in FIGS. 11B, 12, and 14) and a partly relaxed state 42 (shown in FIGS. 2B, 9A, 10, 11A, 11C, 11E, and 14). Partly relaxed state 42 as used herein defines a state in which rigid handle 14 and flexible holder 16 are joined together and flexible holder 16 is not in lengthwise compressed state 40. In other words, partly relaxed state 42 encompasses a state in which T-shirt 12 is not hanging on flexible holder 16 (FIGS. 1, 2B, 9A, 10, 11A, 11E, and 14) and a state in which T-shirt 12 is hanging on flexible holder 16 (FIG. 11C). Skilled persons will recognize that a lengthwise profile 44 of flexible holder 16 in partly relaxed state 42 will vary somewhat, depending on whether T-shirt 12 is hanging on flexible holder 16.

Figure 3:
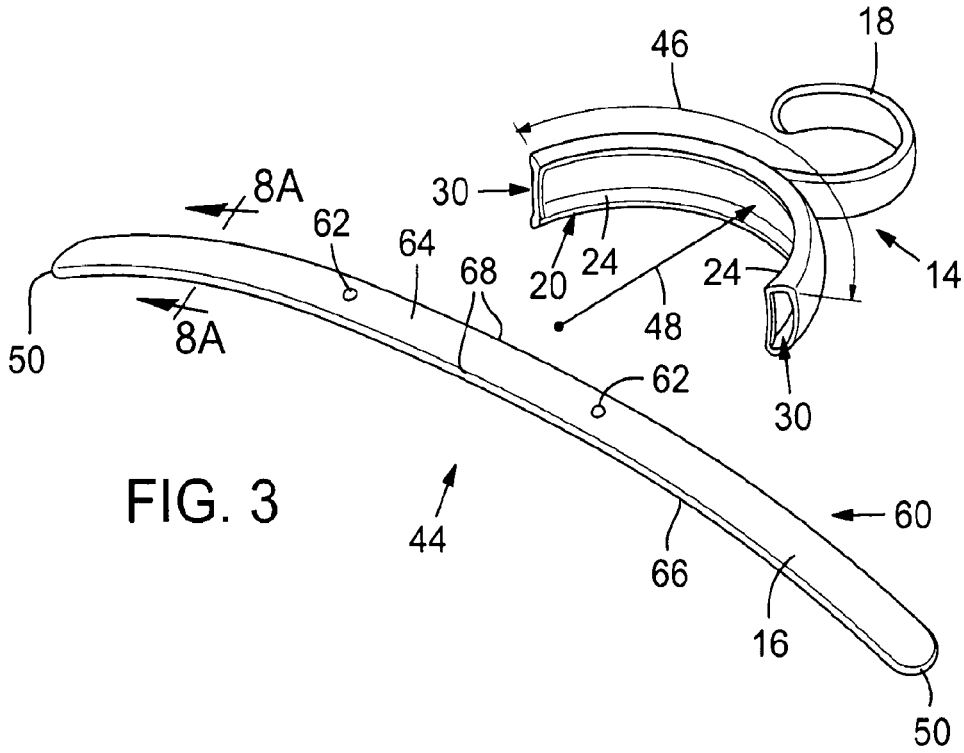
FIG. 3 is a perspective view of the hanger assembly of FIG. 1, with its rigid handle and a flexible holder disassembled.

Arc sections 24 define a circular segment having a segment length 46 and a segment radius 48 as shown in FIG. 3. Segment length 46 is selected to be shorter than a length of a semicircle having radius 48 to thereby prevent failure of flexible holder 16 to relax from lengthwise compressed state 40 to partly relaxed state 42 after a user removes a compressive force applied to it. Segment length 46 is selected also to be sufficiently long to bring rounded holder ends 50 of flexible holder 16 sufficiently close together in lengthwise compressed state 40 for insertion into a neck opening 52 of T-shirt 12.

Holder carrier portion 20 need not be of curved shape as previously described. For example, FIGS. 4, 5, 6, and 7 are frontal views of alternative shapes of holder carrier portion 20. For each of the alternative shapes of FIGS. 4-7, the distal ends 26 and their corresponding coupling members 28 are positioned at a selected distances $d_1$ and $d_2$ from, at a selected angles $\theta_1$ and $\theta_2$ relative to, center region 22. Distances $d_1$ and $d_2$ and angles $\theta_1$ and $\theta_2$ may be different or the same for different shapes. Moreover, $d_1$ and $d_2$ are preferably equal in length but may be different, and angles $\theta_1$ and $\theta_2$ are preferably the same angle but may be different. Distances $d_1$ and $d_2$ and angles $\theta_1$ and $\theta_2$ are selected to bring rounded holder ends 50 sufficiently close together in lengthwise compressed state 40 for insertion into neck opening 52 of T-shirt 12. Moreover, distances $d_1$ and $d_2$ and angles $\theta_1$ and $\theta_2$ prevent failure of flexible holder 16 to relax from lengthwise compressed state 40 to partly relaxed state 42 after a user releases a compressive force applied to it.

Figure 8A:
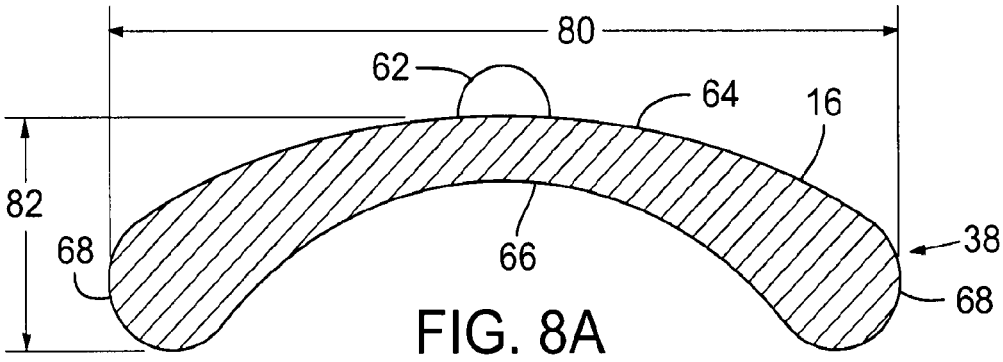
FIG. 8A is a sectional view of the flexible holder taken along lines 8A-8A of FIG. 3.
Figure 8B:
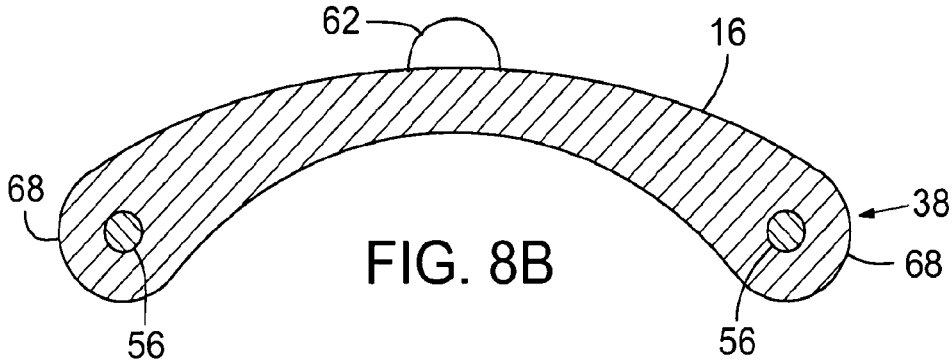
FIG. 8B is a sectional view of an alternative flexible holder, in which the flexible holder of FIG. 8A is modified to include two spaced-apart metal wires running along its length and within its interior.
Figure 8C:
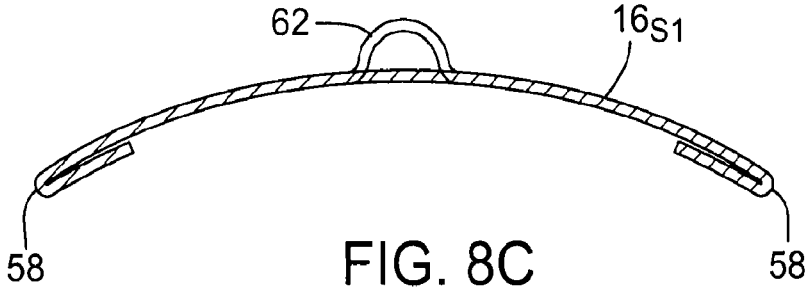
FIGS. 8C and 8D are cross-sectional views of alternative flexible holders that are formed of stamped spring steel, respectively, with and without hemmed edges.
Figure 8D:
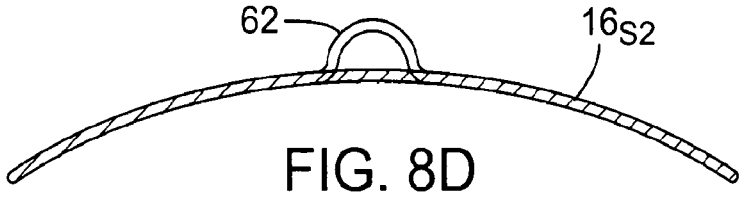

Flexible holder 16 is made of material that is flexible and resilient so that it yields to a lengthwise compressive force, but relaxes back to partly relaxed state 42 after being compressed. Moreover, flexible holder 16 is sufficiently strong to support the weight of T-shirt 12 yet sufficiently flexible to bend slightly downward to substantially conform to a shoulder line profile 54 (FIG. 11C) of T-shirt 12. FIG. 8A shows a first example, in which flexible holder 16 is made of molded plastic. FIG. 8B shows a second example, in which flexible holder 16 of FIG. 8A is modified to include two metal wires 56, such as piano strings, molded in plastic. FIGS. 8C and 8D show cross-sectional views of third and fourth examples of alternative flexible holders formed of stamped spring steel. FIG. 8C shows a flexible holder $\mathbf{16}_{s1}$ that is formed of stamped spring steel with hemmed edges 58 providing smooth end surfaces, and FIG. 8D shows a flexible holder $\mathbf{16}_{s2}$ that is formed of stamped spring steel without hemmed edges.

When it is disassembled from rigid handle 14, flexible holder 16 assumes a rest state 60 in which the lengthwise profile 44 of flexible holder 16 is in the form of a bow shape as shown in FIG. 3. When it is coupled with rigid handle 14 and in partly relaxed state 42, flexible holder 16 assumes a centered position with respect to coupling members 28. The centered position of flexible holder 16 is established by stop members 62 that protrude from one or more of top surface 64, bottom surface 66, and end surfaces 68 of flexible holder 16. In one example, stop members 62 are dome or bulge shaped. Stop members 62 are positioned to cooperate with coupling members 28 to prevent longitudinal sliding of flexible holder 16 to an extent that would result in its disengagement from rigid handle 14. Stop members 62 also help flexible holder 16 maintain its centered position with respect to coupling members 28 as flexible holder 16 transitions between lengthwise compressed state 40 and partly relaxed state 42. For example, stop members 62 may be positioned on top surface 64 and located proximal to and inward from convex segments 32 to prevent substantial longitudinal sliding of flexible holder 16. Portions of flexible holder 16 in its centered position constitute flexible wings 70 that are of substantially equal lengths 72 and extend in opposite directions outwardly from coupling members 28.

In partly relaxed state 42, lengthwise profile 44 of flexible holder 16 assumes a curved shape that follows shoulder line profile 54 of T-shirt 12. A length 74 of flexible holder 16 is selected to allow its flexible wings 70 to span beyond coupling members 28 a distance that enables T-shirt 12 to hang on flexible holder 16 in partly relaxed state 42. For example, in partly relaxed state 42, flexible holder 16 follows shoulder line profile 54 of T-shirt 12, and rounded holder ends 50 contact end-of-shoulder seams 76 of T-shirt 12 to thereby prevent flexible holder 16 from forming unsightly hanger bulges or other deformities along shoulder line profile 54 of T-shirt 12. The distances between end-of-shoulder seams 76 of T-shirts 12 in sizes ranging from infant size to extra large size specify a range of typical lengths 74 of flexible holder 16.

Cross-sectional profile 38 of flexible holder 16 is preferably of meniscus shape with rounded (i.e., soft edged) end surfaces 68 as shown in FIGS. 8A and 8B. Cross-sectional profile 38 is configured to achieve buckle-free bending of flexible holder 16 when it is in a lengthwise break-free state 78, which is described below with reference to FIGS. 11D and 13. In one example, flexible holder 16 has a width 80 of about 20 millimeters (mm) and a height 82 of about 5.5 mm.

Figure 9B:
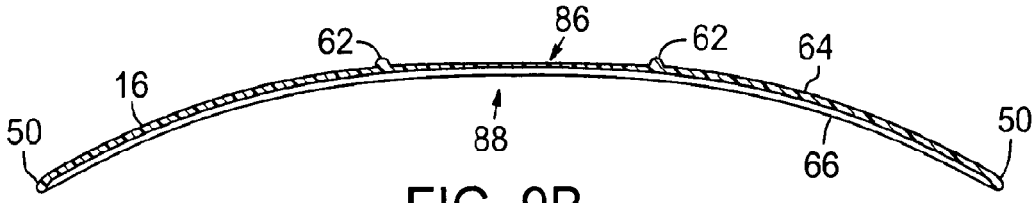
Figure 9C:
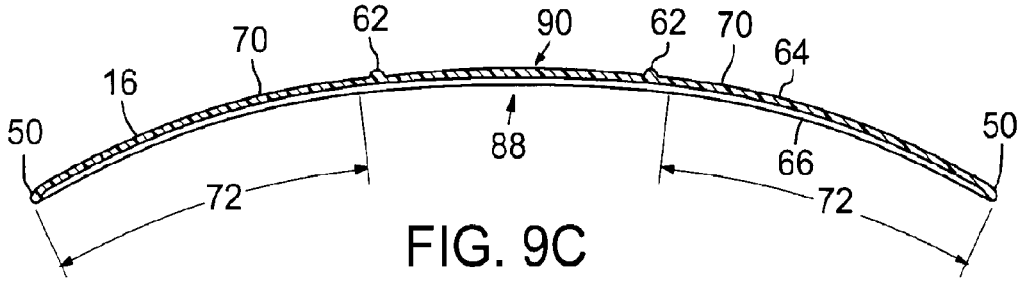

FIGS. 9A, 9B, and 9C show flexible holder 16 embodied in three alternative longitudinal cross-sectional profiles. FIG. 9A, which depicts flexible holder 16 assembled with rigid handle 14, shows flexible holder 16 having along its length 74 a uniform longitudinal cross-sectional profile 84. FIG. 9B shows flexible holder 16 having a nonuniform longitudinal cross-sectional profile 86, in which a center portion 88 extending between distal ends 28 of rigid handle 14 tapers inwardly from stop members 62 and thereby facilitates bending of flexible holder 16 in lengthwise compressed state 40. FIG. 9C shows flexible holder 16 having a nonuniform longitudinal cross-sectional profile 90, in which wings 70 taper along lengths 72 in an outward direction toward holder ends 50 to thereby provide strength for flexible holder 16 at center portion 88 and to allow wings 70 to easily flex downward when T-shirt 12 is being removed.

Operation of hanger assembly 10 is illustrated in FIGS. 10, 11A, 11B, 11C, 11D, 11E, 12, 13, and 14, in which FIG. 10 depicts hanger assembly 10 preparatory to a user applying an upwardly directed compressive force to center portion 88 of flexible holder 16. FIGS. 11A-11E illustrate a sequence of five operational states of hanger assembly 10.

Figure 12:
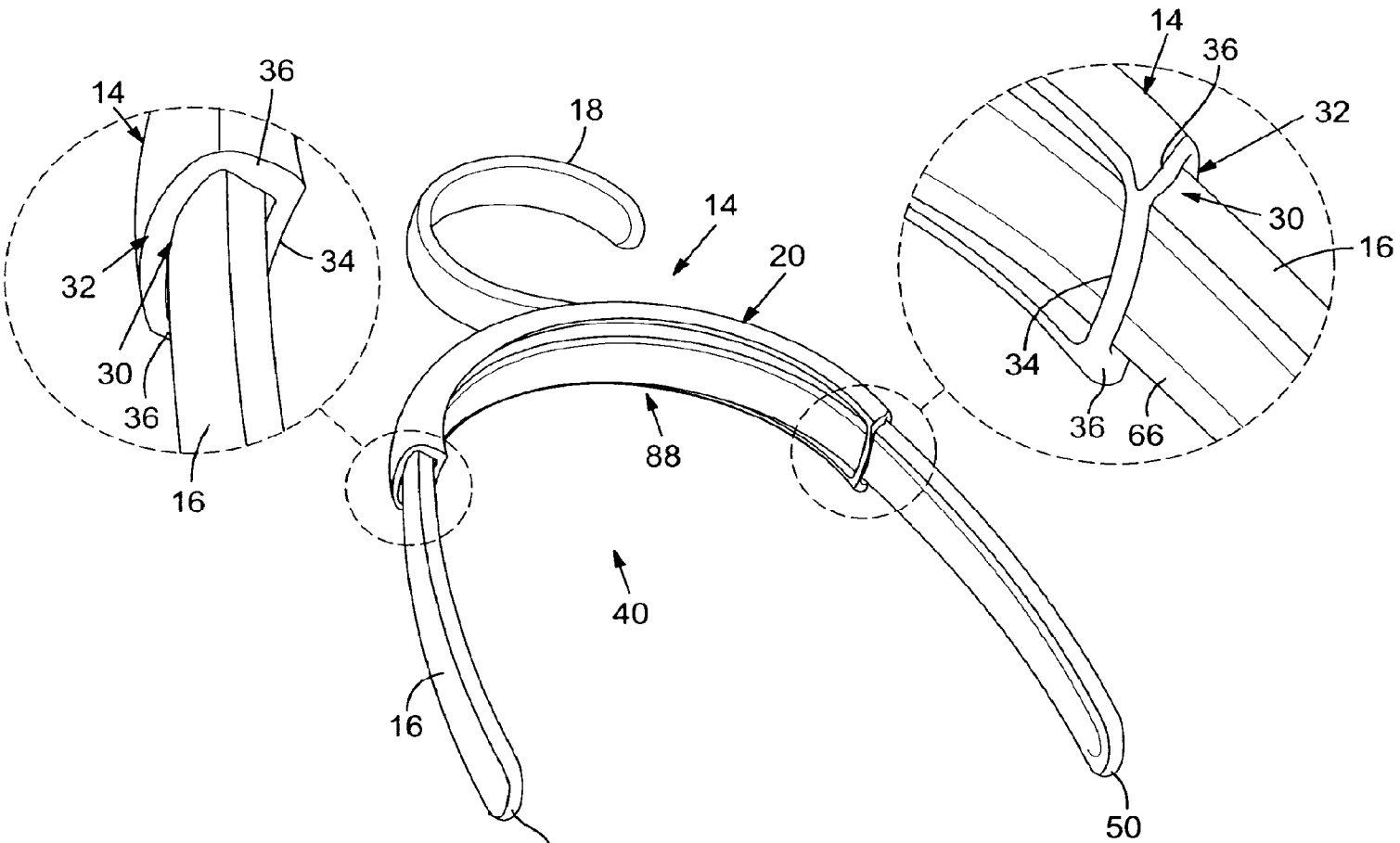
FIG. 12 shows, for the hanger assembly of FIG. 11B, the bending of the flexible holder and the complementary shapes of the coupling member apertures and the flexible holder in the lengthwise compressed state.

To insert hanger assembly 10 into an interior 94 of T-shirt 12, the user takes hanger assembly 10 in its partly relaxed state (FIG. 11A). The user squeezes his hand around rigid handle 14 and flexible holder 16 and applies an upwardly directed compressive force to center portion 88 of flexible holder 16 to transition it from partly relaxed state 42 to lengthwise compressed state 40 (FIG. 11B). The compressive force causes flexible holder 16 to bend upward at center portion 88 and to slide relative to coupling members 28. FIG. 12 shows the bending of flexible holder 16 and the complementary shapes of apertures 30 and flexible holder 16 in lengthwise compressed state 40. In lengthwise compressed state 40, holder ends 50 are brought closer together, as shown in FIGS. 11B and 12, to enable insertion of them through neck opening 52 of T-shirt 12 to its interior 94 without substantially stretching neck opening 52.

After the user inserts holder ends 50 in interior 94 of T-shirt 12, the user releases the compressive force to transition flexible holder 16 from lengthwise compressed state 40 back to partly relaxed state 42. When the user releases the compressive force, center portion 88 of flexible holder 16 relaxes downward, flexible holder 16 slides relative to coupling members 28, and holder ends 50 spread apart to allow T-shirt 12 to hang on wings 70 of flexible holder 16 (FIG. 11C). As previously described, the shape and configuration of holder carrier portion 20 prevents flexible holder 16 from becoming stuck in lengthwise compressed state 40 after the user releases the compressive force. The weight of T-shirt 12 causes wings 70 to substantially conform to shoulder line profile 54 of T-shirt 12 as it hangs.

Figure 13:
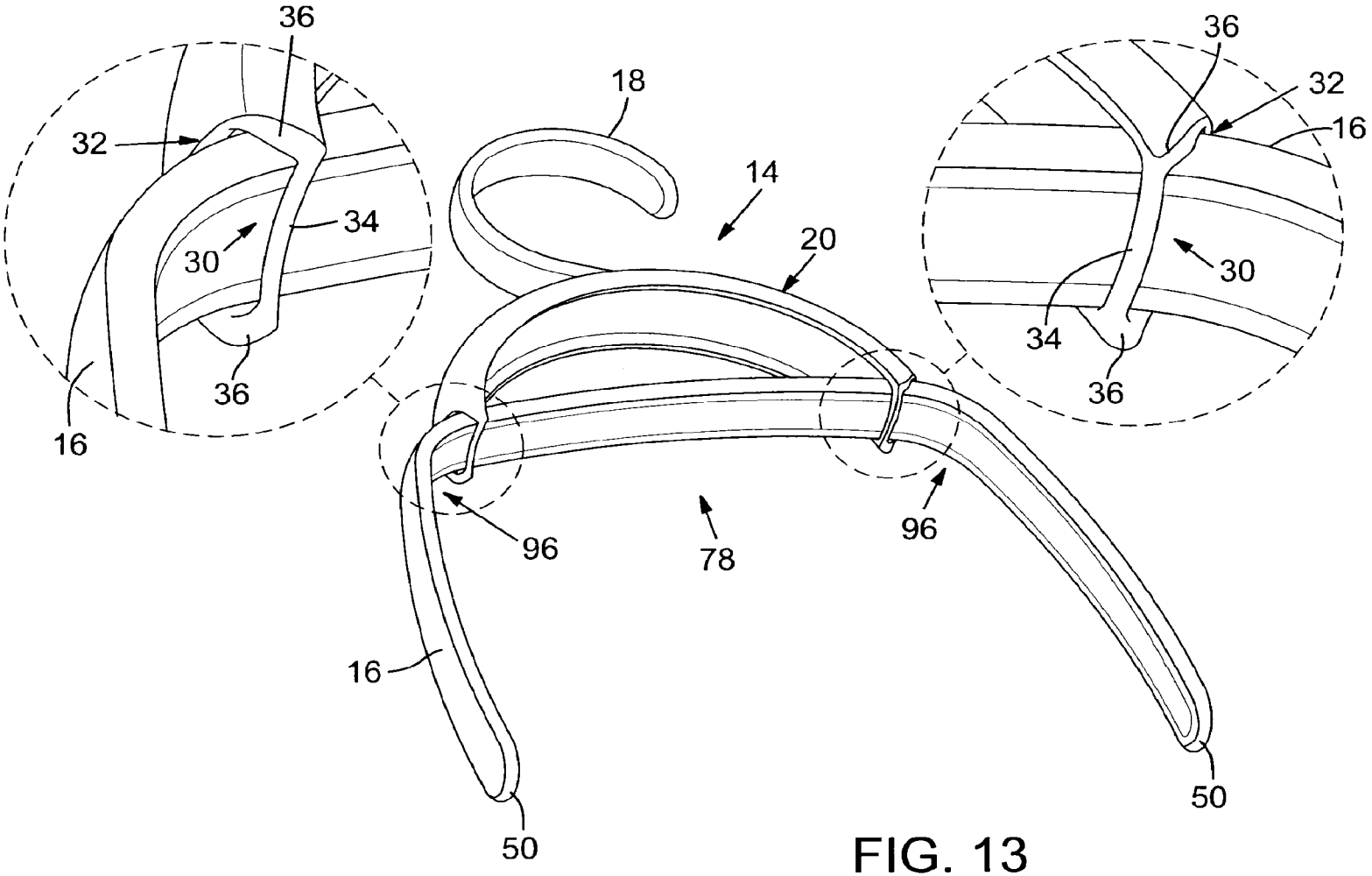
FIG. 13 shows, for the hanger assembly of FIG. 11D, the break away bending collapse and the complementary shapes of the coupling member apertures and the flexible holder in the break-free state.

To remove T-shirt 12 from hanger assembly 10, the user pulls down on T-shirt 12 (e.g., applies a garment removal force) and wings 70 bend downward (e.g., fold at regions 96 near coupling members 28) to transition flexible holder 16 from partly relaxed state 42 to break-free state 78. Cross-sectional profile 38 establishes a break away bending collapse of wings 70 so that, after such collapse takes place, minimal user-applied pulling force to T-shirt 12 is required to bring holder ends 50 closer together to allow T-shirt 12 to slide off wings 70 through neck opening 52 (FIG. 11D). Preferably, top surface 64 of flexible holder 16 is relatively smooth to allow T-shirt 12 to easily slide off wings 70 when the user pulls down on T-shirt 12. The break away bending collapse occurring in break-free state 78 causes wings 70 to bend down and rounded holder ends 50 converge toward each other by an appreciable amount and thereby results in no appreciable stretching of neck opening 52 when T-shirt 12 is being removed. FIG. 13 shows the break away bending collapse and the complementary shapes of apertures 30 and flexible holder 16 in break-free state 78. Once T-shirt 12 is pulled off wings 70, flexible holder 16 returns to partly relaxed state 42 (FIG. 11E).

Figure 14:
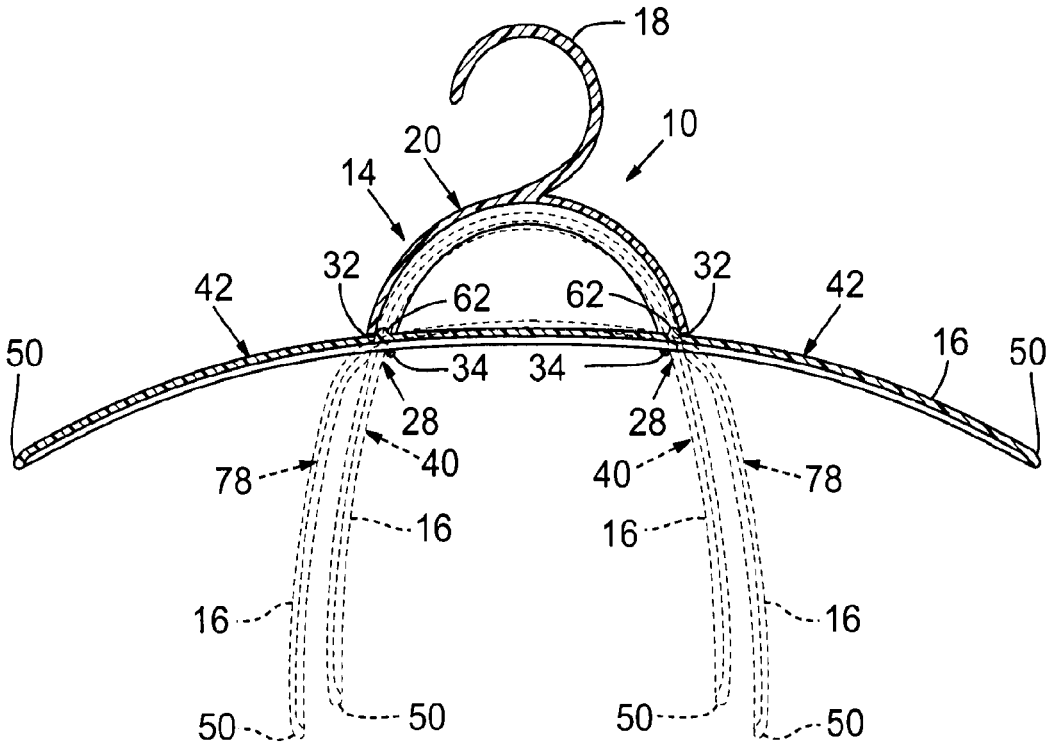
FIG. 14 shows enlarged longitudinal cross-sectional views of the hanger assembly of FIG. 1, illustrating its flexible holder with solid lines in the partly relaxed state of FIGS. 11A and 11B, with phantom lines in the longitudinal compressed state of FIGS. 11B and 12, and with phantom lines in the break-free state of FIGS. 11D and 13.

FIG. 14 shows enlarged longitudinal cross-sectional views of hanger assembly 10, illustrating its flexible holder 16 with solid lines in partly relaxed state 42 of FIGS. 11A and 11B, with phantom lines in longitudinal compressed state 40 of FIGS. 11B and 12, and with phantom lines in break-free state 78 of FIGS. 11D and 13.

It will be obvious to skilled persons that many changes may be made to the details of the above-described embodiments without departing from the underlying principles of the invention. The scope of the present invention should, therefore, be determined only by the following claims.

The invention claimed is:

1. A hanger assembly for hanging a pullover garment from its top, the pullover garment having a neck opening, an interior, and a shoulder line profile, comprising:

a handle including a holder carrier portion and a hook portion, the holder carrier portion including first and second support arms having distal ends that terminate in respective first and second opposed coupling members, and the hook portion positioned medially between the first and second coupling members; and an elongated unitary flexible holder that, when joined with the handle to form the hanger assembly, is operationally coupled for lengthwise slidable engagement with the first and second coupling members, the flexible holder having holder ends and a lengthwise profile, a cross-sectional profile, and a length, the lengthwise profile configured to define a bow shape in a rest state, the cross-sectional profile configured to achieve, in response to a holder compressive applied force, bending of the flexible holder in a lengthwise compressed state and thereby bring closer together the holder ends to enable insertion of the holder ends through the neck opening to the interior of the pullover garment, and in response to a garment removal applied force, buckle-free bending of the flexible holder in a lengthwise break-free state and thereby bring closer together the holder ends to enable removal of the holder ends through the neck opening from the interior of the pullover garment, and the length selected to achieve, in response to removal of the holder compressive applied force and a consequent relaxation of the flexible holder from the compressed state to a partly relaxed state, a spreading apart of the holder ends to allow the flexible holder to span beyond each of the first and second coupling members a distance that enables the pullover garment to hang on the flexible holder, with the flexible holder following the shoulder line profile of the pullover garment.

2. The hanger assembly of claim 1, in which the first and second support arms include respective first and second rigid arc sections that establish a curved shape for the holder carrier portion.

3. The hanger assembly of claim 2, in which the first and second rigid arc sections define a circular segment having a segment radius and a segment length, the segment length being shorter than a length of a semicircle having the segment radius, thereby to prevent failure of the flexible holder to relax from the lengthwise compressed state to the partly relaxed state after removal of the holder compressive applied force.

4. The hanger assembly of claim 1, in which the distal ends of the first and second support arms are at selected distances from, and at selected angles relative to, a center region of the holder carrier portion.

5. The hanger assembly of claim 4, in which the selected distances and the selected angles corresponding to the distal ends prevent failure of the flexible holder to relax from the lengthwise compressed state to the partly relaxed state after removal of the holder compressive applied force.

6. The hanger assembly of claim 1, in which the first and second opposed coupling members include respective first and second apertures configured to receive and allow movement of the flexible holder relative to the support arms to achieve the operational coupling for slidable engagement.

7. The hanger assembly of claim 6, in which each of the first and second apertures includes opposed convex and concave segments interconnected by opposed convex lateral segments, the opposed convex and concave segments and opposed convex lateral segments shaped for compatibility with the cross-sectional profile of the flexible holder so as to accommodate the slidable engagement of the flexible holder in transitional bending between the lengthwise compressed state and the partly relaxed state.

8. The hanger assembly of claim 7, in which the opposed convex and concave segments and the opposed convex lateral segments define a closed perimeter for each of the first and second apertures.

9. The hanger assembly of claim 1, in which the flexible holder assumes a centered position when in the partly relaxed state and includes first and second stop members positioned to cooperate with the respective first and second opposed coupling members to prevent displacement of the flexible holder from the centered position after transitional bending of the flexible holder between the lengthwise compressed state and the partly relaxed state.

10. The hanger assembly of claim 1, in which the cross-sectional profile of the flexible holder is of meniscus shape with rounded end surfaces.

11. The hanger assembly of claim 1, in which the flexible holder is formed of molded plastic that establishes the bow shape in the rest state.

12. The hanger assembly of claim 1, in which the flexible holder includes a metal wire core molded in plastic to establish the bow shape in the rest state.

13. The hanger assembly of claim 1, in which the flexible holder is formed of spring steel that establishes the bow shape in the rest state.

14. The hanger assembly of claim 1, in which the hook portion is an integral part of the holder carrier portion to establish a unitary structure for the handle.

15. The hanger assembly of claim 1, in which the flexible holder includes first and second flexible wings that extend outward from, respectively, the first and second coupling members to the holder ends and follow the shoulder line profile of the pullover garment when in the partly relaxed state, the first and second flexible wings configured to achieve, in response to the garment removal force applied to the pullover garment, break-free bending that results in collapse of the first and second flexible wings, thereby to allow, with substantially reduced applied garment removal force, the pullover garment to be removed from the hanger assembly through the neck opening without appreciable stretching of the neck opening.

16. The hanger assembly of claim 15, in which the first and second flexible wings have a longitudinal cross-sectional profile that is non-uniform along the length of the flexible holder.

* * * * *